United States Patent [19]

Culling

[11] Patent Number: 4,824,638

[45] Date of Patent: Apr. 25, 1989

[54] CORROSION RESISTANT ALLOY

[75] Inventor: John H. Culling, St. Louis, Mo.

[73] Assignee: Carondelet Foundry Company, St. Louis, Mo.

[21] Appl. No.: 176,409

[22] Filed: Apr. 1, 1988

Related U.S. Application Data

[63] Continuation-in-part of Ser. No. 067,220, Jun. 29, 1987, abandoned.

[51] Int. Cl.[4] ..... C22C 30/02

[52] U.S. Cl. ..... 420/582; 420/584; 420/587

[58] Field of Search ..... 420/582, 584, 587

[56] References Cited

U.S. PATENT DOCUMENTS

| | | | |
|---|---|---|---|
| T967,001 | 2/1978 | Brown et al. | 420/582 |
| 2,506,518 | 5/1950 | Norris | 420/582 |
| 3,044,871 | 7/1962 | Mott | 420/582 |
| 3,726,668 | 4/1973 | Bäumel | 420/582 |
| 3,837,846 | 9/1974 | Becker et al. | 420/582 |
| 4,078,920 | 3/1978 | Liljas et al. | 420/582 |
| 4,201,575 | 5/1980 | Henthorne et al. | 148/442 |
| 4,400,349 | 8/1983 | Kudo et al. | 420/582 |
| 4,410,489 | 10/1983 | Asphahani et al. | 420/582 |
| 4,421,557 | 12/1983 | Rossomme et al. | 420/584 |
| 4,430,297 | 2/1984 | Crook | 420/582 |
| 4,487,744 | 12/1984 | DeBold et al. | 420/584 |

FOREIGN PATENT DOCUMENTS

| | | | |
|---|---|---|---|
| 1960025 | 6/1971 | Fed. Rep. of Germany | 420/582 |
| 0110904 | 9/1978 | Japan | 420/582 |
| 0021547 | 2/1980 | Japan | 420/584 |
| 0171651 | 10/1982 | Japan | 420/584 |
| 0182937 | 10/1984 | Japan | 420/582 |
| 1099656 | 5/1986 | Japan | 420/582 |

*Primary Examiner*—L. Dewayne Rutledge
*Assistant Examiner*—David Schumaker
*Attorney, Agent, or Firm*—Senninger, Powers, Leavitt and Roedel

[57] ABSTRACT

The alloys of this invention are of low strategic element content, non-magnetic, resistant to chloride-containing solutions as well as a wide range of other chemical agents, air-meltable, castable, of greatly improved fabricability and weldability, and consist by weight percentages of from about 20.5% to about 35.5% by weight Ni, from about 23.5% to about 27.5% by weight Cr, from about 4.0% to about 6.7% by weight Mo, from about 0.7% to about 3.6% by weight Cu, up to about 0.09% by weight C, up to about 1.5% by weight Si, up to about 5% by weight Co, up to about 0.45% by weight N, up to about 1% by weight Ti, up to about 0.8% by weight Cb, and up to about 0.3% by weight Ce, La or Misch metal, up to about 2% by weight Mn, up to about 1.6% by weight Ta, and the balance essentially iron.

The combined content by weight of Ni plus Co is at least about 25.5% by weight and exceeds the weight content of Cr by at least 2% but by not more than 8%.

12 Claims, No Drawings

CORROSION RESISTANT ALLOY

This application is a continuation-in-part of Ser. No. 07/067,220, filed June 29, 1987, now abandoned.

BACKGROUND OF THE INVENTION

Much of the world, including much of the highly industrialized parts of the world, has a chronic shortage of fresh water for any and all uses. This shortage has led to increasing employment of seawater or brackish water in the cooling of chemical process equipment and power plants. Consequently, there has been an increased need for materials of construction that are resistant to seawater and to chemical process streams that may be cooled with seawater. Of course, there is also great advantage in metal alloys resistant to seawater for numerous ship, platform and dock construction applications.

Remarkable alloys have been developed for resistance to salt water plus some limited ranges of chemical substances. Some of these, such as Hastelloy B, Hastelloy C, Hastelloy G, Inconel 625, Illium B, and Allcorr have excellent resistance to chloride and certain other substances, but consist almost entirely of strategic elements and are hence extremely expensive and, therefore, limited in use.

Of more recent invention have been less-expensive, highly-modified stainless steels for seawater resistance. These include the ferritic type, available only in wrought forms, and austenitic types such as Al-6X, 254SMO, 904L, VEWA963, NSCD and SANICRO 28. While some of these have rather low strategic element content, each has one or more disadvantages. Seawater resistance may be high but not complete, such that there remain instances of failure under fouling, during shutdown periods, or otherwise. In some instances, fabricability and weldability are possible but somewhat limited and costly. In other instances, resistance to seawater is excellent, but resistance ot other agents, such as various chemical process streams, is somewhat limited. Some variations may be available only as cast shapes.

Hence, there remains a need for alloys of relatively low strategic element content but which are completely resistant to seawater and a wide range of chemical substances, and yet are truly very highly fabricable.

Japanese Pat. No. 9182-937A describes an electricity application roll for electric plating. The roll is constructed of an alloy consisting of less than 0.05% by weight carbon, less than 1.00% by weight silicon, less than 2.00% by weight manganese, 18.0% to 25.0% by weight chromium, 5.00% to 8.00% by weight molybdedum, 18.0% to 25.0% by weight iron, 1.06% to 5.00% by weight copper, niobium and/or tantalum in a proportion of 1.75% to 2.50% by weight, and at least one from among aluminum in a proportion of less than 0.5% by weight, titanium in a proportion below 1.00% by weight, and cobalt in a proportion below 5.00% by weight. The balance of the alloy is nickel. The alloy is said to have sufficient corrosion resistance even when the plating liquid is at PH 0.6 to 1.6. The included proportions of niobium plus tantalum provides for stabilization of carbon in the austenite phase and are said to provide intergranular corrosion resistance. The iron inclusion is described as providing excellent hot workability as well as weldability.

Mott U.S. Pat. No. 3,044,871 describes a hardenable corrosion-resistant stainless steel adapted to handle corrosives where an erosion or abrasion condition exists. The alloys broadly contain up to 0.07% by weight carbon, 15% to 32.5% by weight chromium, 25% to 35% by weight nickel, 0.2% to 7% by weight silicon, 0.2% to 4% by weight manganese, 1% to 5% by weight copper and 2% to 20% by weight molybdenum. Consistent with the objective of achieving hardness and erosion resistance, many of the alloys contain significant proportions of silicon in the range of approximately 2.0% to 5.0%.

Baumel U.S. Pat. No. 3,726,668 describes a welding filler material containing 0.001% to 0.2% by weight carbon, 0.1% to 5.0% by weight silicon, 0.25% to 10.0% by weight manganese, 15.0% to 25.0% by weight chromium, 3.5% to 6.0% by weight molybdenum, 8.0% to 30.0% by weight nickel, 0.01% to 3.0% by weight copper, 0.1% to 0.35% by weight nitrogen, related to the total weight of the metallic constituents and carbon, the balance essentially iron and inevitable impurities. The filler material is said to be useful in providing fully austenitic surface weld layers or welded joints which are insusceptible to hot cracking on predominantly austenic base materials, particularly chromium-nickel steels.

Japanese Pat. No. 7171-651 describes austenitic stainless steel having good weld zone corrosion resistance and consisting of less than 0.04% by weight carbon, less than 1.5% by weight silicon, less than 2.0% by weight manganese, 18.0% to 25.0% by weight chromium, 20.0% to 30.0% by weight nickel, 4.0% to 8.0% by weight molybdenum, 0.01% to 0.3% by weight nitrogen, aluminum in a proportion of less than 0.02% by weight, lanthanum plus cerium in a proportion of 0.01% to 0.06% by weight, additional boron in a proportion of less than 0.01% by weight, or copper in a range of 0.3% to 3.0% by weight with boron less than 0.1%, and the balance essentially iron and impurities. The steel is said to be always in the austenitic state irrespective of any heat treatment and to have good corrosion resistance to sea water and in the weld zone.

A need has remained in the art for alloys of relatively low strategic metal content which can be used in corrosive chemical process stream service, and in particularly in applications requiring resistance to chloride stress corrosion.

SUMMARY OF THE INVENTION

Among the several objects of the present invention, therefore, may be noted the provision of improved alloys resistant to chlorides as well as to an exceptionally wide range of chemical streams, the provision of such alloys which are exceptionally fabricable and weldable; the provision of such alloys which are resistant to process streams of corrosive fluids such as may be encountered in heat exchangers and other process equipment used in power and chemical plants; the provision of such alloys which may be economically formulated with relatively low proportions of strategic metals such as nickel, chromium and molybdenum; the provision of such alloys whose strategic metal contents are sufficiently low that they may be readily formulated from such relatively low-cost raw materials as scraps, ferro alloys or other commercial melting stock; the provision of such alloys which can be cast or wrought; the provision of such alloys which have low hardnesses and high ductilities so that they may be easily rolled, forged, welded or machined; the provision of such alloys which are air-meltable and air-castable; the provision of such alloys which are substantially non-magnetic; the provision of such alloys that do not require heat treatment before or after welding, machining or forming; the provision of such alloys which resist pitting attack, crevice corrosion attack, stress corrosion cracking failure, intergranular attack and broad surface attack by the widest range of chemical substances.

Briefly, therefore, the present invention is directed to an air-meltable, castable, workable, non-magnetic alloy resistant to chlorides and a variety of chemical streams over a range of liquid velocities at the alloys surface. The alloy consists essentially of between about 20.5% and about 35.5% by weight Ni, from about 23.5% to about 27.5% by weight Cr, from about 4.0% to about 6.7% by weight Mo, from about 0.7% to about 3.6% by weight Cu, up to about 0.09% by weight C, up to 1.5% by weight Si, up to about 5% by weight Co, up to about 0.45% N, up to about 1% by weight Ti, up to about 0.8% by weight Cb, and up to about 0.3% by weight Ce, La or Misch metal, up to about 2% by weight Mn, up to about 1.6% by weight Ta, and the balance essentially iron. The sum of the nickel content and the cobalt content is between about 25.5% and about 35.5% by weight and exceeds the chromium content by between about 2% and about 8% by weight, basis the entire alloy.

It is particularly preferred that the alloys of the invention have a nickel content of not greater than about 32% by weight, that the sum of the nickel and cobalt contents be not greater than about 32% by weight, and that the nickel content exceed the chromium content by not more than about 6.2% by weight.

DESCRIPTION OF THE PREFERRED EMBODIMENT

In accordance with the present invention, alloys are provided which are virtually immune to seawater and are at the same time very highly resistant to a wide variety of chemical streams.

The alloys of the invention are air-meltable and air castable and possess advantageous mechanical properties which render them suitable as materials of construction of any and all metallic shapes and parts.

Unlike the nickel-base alloys which are often used in seawater service, the alloys of the present invention can be formulated from ferro-alloys, scraps and commercial melting stocks.

The nickel levels in the alloys of this invention are such as to maintain a single-phase, austenitic crystal structure. In part, the exceptional corrosion resistance of these alloys is due to careful control of the Ni content within a fairly narrow range. However, to achieve maximum corrosion resistance, it has been found important that the sum of the weight concentrations of Ni plus Co exceed the weight content of Cr by at least 2.0%, but not more than 8%, basis the entire alloy. For most applications, it is strongly preferred that the sum of the nickel and cobalt contents does not exceed the chromium content by more than about 6.2% by weight. Advantageously, the difference between the sum of the nickel and cobalt contents and the chromium content is in the range of 2.5–6.2% by weight. Most preferably, the Ni+Co content exceeds the Cr content by at least 3.5% but not more than 5%.

In numerous tests, I have determined that even lower Ni contents may preserve the single-phase austenitic structure but result in some loss of seawater resistance. Through extensive corrosion testing of elements in the ranges of proportions employed in the alloys of this invention, I have discovered that, provided that Ni alone, or the sum of Ni+Co, exceeds the Cr content by a margin of at least 0.5% to 2% on an entire alloy basis, while the Cu content is at least 1.8% by weight, and other element concentrations meet the requirements of the invention, the resultant alloys still resist most chemical substances remarkably well. However, their salt water resistance is somewhat lowered, though onset of salt water attack is still greatly delayed compared to many alloys designed for sea service.

Nickel concentrations can range as high as 35.5% in the alloys of this invention, especially where the carbon content is low, e.g., below about 0.03% by weight. However, Ni concentrations higher than 32% are unnecessarily expensive and causes some deterioration of corrosion resistance in certain chemical substances, usually those of a more oxidizing nature. High nickel content may reduce the solubility of carbon in the matrix phase, requiring disproportionate amounts of carbide stabilizers such as Cb (Nb), Ta, and/or Ti to prevent carbide precipitation and intergranular corrosion. As noted, it is particularly preferred, for resistance to some of the more aggressive chemical agents, that the combination of Ni plus Co exceed the Cr content by not less than about 2.5% and not more than about 6.2%, most advantageously 3.5–5%, by weight.

Manganese has been employed in the range of about 3 to 5% in a number of my alloys in the past and in certain other alloys. It enhances seawater resistance in many of these and serves as a partial substitute for nickel as an austenitizer. Mn contents above about 2% are of no advantage in alloys of the present invention and indeed would require higher Ni contents if Mn were much above the 2%.

Nitrogen has been employed as an additional austenite stabilizer in a number of commercial alloys and as such has been partially substituted for Ni. Furthermore, N has been used to enhance seawater resistance of many commercial alloys such as AL-6X, 254SMO, VEWA963 and others. However, nitrogen additions do not enhance the seawater resistance in alloys of this invention, and slightly reduce their resistance to certain other chemical substances. Nevertheless, the alloys of the invention are adapted for air melting and, in air melting, N is often absorbed from the air. It has been discovered that in alloys of the present invention N many be tolerated up to about 0.45% without causing pinholes, bleeding or cracking as ingots and castings freeze to solid state. However, for many services, the N content should be controlled at a level no higher than that nominally absorbed during the melting and casting processes. Therefore, a maximum of about 0.30% N is preferred and 0.25% N or less is often even better.

Maintaining the Ni+Co content at not greater than about 6.2% higher than the chromium content helps assure that consumption of carbide stabilizers by nitride formation during air melting does not result in carbide precipitation and intergranular corrosion.

Molybdenum content of the alloys of this invention varies between about 4 and about 6.7%. For complete immunity to seawater the Mo content must not fall below that given by the formula:

$$[Mo] \geqq \frac{31}{[Cr] - 12} + 2$$

Thus, if the Cr level is at the maximum of the range, 27.5% Cr, the minimum Mo content is 4%. If the Cr is at the minimum value of 23.5%, then the minimum Mo content is 4.7%.

The other elements of the alloys of this invention are chosen so that the alloys are still single-phase austenitic in those instances where Mo content rises as much as 2% above minimum values; this was done because of the practical necessity of having a "working range" of element variations in air-melted alloys. Generally, it is preferred that the maximum Mo content be governed by the relationship:

$$[Mo] \leqq \frac{31}{[Cr] - 12} + 4$$

If Mo content were to exceed the level so defined, then Ni and/or N contents would have to be increased to maintain the austenitic structure. In addition, at such levels of Ni of N, corrosion resistance in many oxidizing media deteriorates, along with ductility and fabricability. In actuality the preferred range for best overall corrosion resistance and mechanical properties is achieved when maximum Mo content is held to about 1.5% over the minimum set by the above formula. This still provides a reasonable working range of elements while optimizing physical, mechanical, metallurgical, and chemical properties.

Copper content of the alloys of this invention ranges from about 0.7 to about 3.6%. Higher Cu contents favor corrosion resistance in very hot concentrated sulfuric acid but tend to decrease resistance in many other media and also begin to affect mechanical properties adversely. Since very hot concenrated sulfuric acid is a somewhat specialized application for which these alloys are not truly well chosen, they were formulated to meet a multitude of other chemical conditions instead.

While some alloys designed for seawater resistance contain no Cu, the alloys of this invention were found to have their seawater resistance improved by additions of at least 0.7% Cu. In addition, their resistances in most other media were drastically improved by the presence of Cu.

Titanium has recently been named in the literature as improving salt water resistance of certain types of alloys. Since titanium and columbium (niobium) may both be employed, along with Ta, to stabilize carbides after welding or certain other heat treatments, thereby protecting against intergranular corrosion, the effects of Ti and Cb on alloys of the present invention were studied and evaluated. I have found that Ti should be limited to about 1% in these alloys, while Cb should be limited to about 0.8%. I have also determined that Ta can be substituted for Cb on the basis of twice the diminished Cb content. Accordingly, the sum of the Cb and one half the Ta content should not exceed about 0.8% by weight. There is no advantage in substitution of Ta for Cb unless Cb is unavailable, or avilable only as a Cb-Ta ferroalloy. In some test media, Ti or Cb decreases corrosion resistance slightly and, therefore, the presence of either of these elements is recommended in the alloys of the present invention only when economical choices of melting stock cause carbon levels to rise above about 0.03%. If such is the case and welding is desirable, best results are obtained when Ti equals about 4 to 6 times carbon content, or Cb equals about 8 to 10 times carbon content. Thus, where the Ti content is not sufficient to stabilize carbides, it is preferred that the Cb content plus one half the Ta content exceed eight times the carbon content. Or more generally, it is preferred that $$\frac{1}{4}\,Ti + \frac{1}{8}\,Cb + \frac{1}{16}\,Ta \geqq C$$

Carbon levels beyond the 0.09% maximum of these alloys could probably be tolerated with sufficient Ti, Cb or Ta additions stabilize the increase, but the presence of additional carbides tends to decrease fabricability and is thus undesirable.

Cobalt may be substituted for Ni up to about 5%, but not included in a proportion such that the sum of Ni and Co exceeds 35.5%. As indicated, it is strongly preferred that the Ni+Co content not exceed about 32% by weight. There is no chemical, mechanical or economical advantage in substituting Co for Ni, but Co is sometimes present in otherwise pure Ni obtained from Canadian ore deposits.

Vanadium has been permitted in certain of my other alloy inventions but is definitely not desirable in the alloys of the instant invention. Additions of 1 to 4% V to alloys of this invention were intentionally made for purposes of experiment, and found to decrease resistance to hot solutions of phosphoric acid, and also to medium to high concentrations of sulfuric acid. Vanadium should be limited to about 0.75% maximum for best results.

Cerium, Lanthanum or Misch metal may be added up to about 0.3% to enhance workability, but the resulting increase is very modest. Therefore, it is only optionally specified for these alloys.

Silicon is also beneficial to salt water resistance but held to a maximum of about 1.5% in alloys of this invention in order to not adversely affect workability and weldability. Higher Si levels would reauire increases in Ni and unnecessarily raise strategic element contents and cost.

The essential components of the invention are:

| | |
|---|---|
| Nickel plus Cobalt | 25.5–35.5% by weight, with a maximum of 5% Co |
| Chromium | 23.5–27.5% |
| Molybdenum | 4.0–6.7% |
| Copper | 0.7–3.6% |
| Iron | Balance |

The combined contents by weight of Ni plus Co must not exceed the weight content of Cr by at least 2% by by not more than 8% (basis the entire alloy). Preferably, the sum of Ni+Co exceeds Cr by not more than 6.2% by weight. In most applications, Ni+Co−Cr should be 2.5–6.2%, most preferably 3.5–6.2%.

Preferably, the nickel content should be in the range of 20.5 to 32%, and the sum of Ni+Co should be in the range of 25.5% and 32%.

Nominally the alloys of the invention will also contain carbon, up to a maximum of about 0.08% by weight.

Optionally, the alloys of the invention may further contain:

| |
|---|
| Silicon up to 1.5% |
| Manganese up to 2.0% |
| Nitrogen up to 0.45% |
| Titanium up to 1% |
| Columbium up to 0.8% |
| Tantalum up to 1.6% |

-continued

| | |
|---|---|
| Cobalt up to 5% | |
| Cerium, Lanthanum or Misch metal up to 0.3% | |

For best results the Ni content should exceed the Cr content by about 3.5 to about 6.2% by weight, and the Mo content must not fall below the following relationship to chromium set forth hereinabove.

It has been found preferable to restrict the ranges of chemical elements to the following ranges:

| | |
|---|---|
| Nickel (plus Cobalt) | 26–32% |
| Chromium | 23.5–27.5% |
| Molybdenum | 4–6.7% |
| Copper | 0.9–3.5 |
| Manganese | 0.3–2% |
| Columbium | 0–0.55% |
| Nitrogen | 0–0.30% |
| Silicon | 0.2–1% |
| Carbon | 0–0.05% |
| Titanium | 0–0.7% |
| Iron | Balance |
| Nickel plus Cobalt minus Chromium | 2.5–6.2% |

For even better resistance to a wider range of corrosive conditions the components of the alloys of this invention should be even further restricted to the following ranges of proportions:

| | |
|---|---|
| Nickel + Cobalt | 26.5–32% |
| Chromium | 24–27% |
| Molybdenum | 4.1–6.1% |
| Copper | 0.9–2.0% |
| Manganese | 0.3–2% |
| Columbium | 0–0.25% |
| Nitrogen | 0–0.25% |
| Silicon | 0.2–0.8% |
| Carbon | 0–0.03% |
| Iron | Balance |
| Nickel plus Cobalt minus chromium | 3.5–5% |

In an especially preferred embodiment of the invention, where availability of melting stocks easily affords formulation of the appropriate proportions of the components, the following ranges of proportions have been found to optimize physical, chemical, metallurgical and mechanical properties for the widest range of chemical conditions:

| | |
|---|---|
| Nickel + Cobalt | 27.5–32% |
| Chromium | 24–26% |
| Molybdenum | 4.2–5.0% |
| Copper | 0.9–1.6% |
| Manganese | 0.5–1.8% |
| Columbium | 0–0.25% |
| Nitrogen | 0–0.20% |
| Silicon | 0.2–0.8% |
| Carbon | 0–0.03% |
| Iron | Balance |
| Nickel plus Cobalt minus chromium | 3.5–4.5% |

A particularly advantageous alloy having optimum chemical, physical mechanical and metallurgical properties has the following composition:

| | |
|---|---|
| Nickel | 29% |
| Chromium | 25% |

-continued

| | |
|---|---|
| Molybdenum | 4.7% |
| Copper | 1% |
| Manganese | 0.75% |
| Silicon | 0.4% |
| Carbon | 0.02% |
| Iron | Essentially the remainder |

The following examples illustrate the invention.

Example 1

One hundred pound heats of several different alloys were prepared in accordance with the invention. Each of the heats was air-melted in a 100-pound high frequency induction furnace. The composition of these alloys is set forth in Table I, with the balance in each instance being essentially iron.

TABLE I

PERCENT BY WEIGHT OF ALLOYING ELEMENTS

| ALLOY NUMBER | Ni | Cr | Mo | Cu | Mn | Cb | Si | C | Ti | N |
|---|---|---|---|---|---|---|---|---|---|---|
| 1418 | 28.11 | 24.50 | 4.63 | 1.05 | 1.62 | — | .62 | .02 | — | — |
| 1420 | 28.92 | 24.91 | 4.66 | 1.13 | 1.86 | — | .72 | .02 | .40 | .20 |
| 1423 | 29.55 | 25.93 | 4.93 | 1.18 | 0.76 | .13 | .42 | .01 | — | .11 |
| 1424 | 29.02 | 25.32 | 4.91 | 2.30 | 0.75 | .12 | .39 | .01 | — | .14 |
| 1425 | 31.20 | 25.03 | 4.90 | 3.40 | 0.77 | .11 | .37 | .01 | — | .13 |
| 1421 | 31.35 | 27.31 | 4.08 | 1.57 | 0.68 | — | .57 | .02 | — | .33 |
| 1422 | 27.61 | 23.68 | 6.11 | 1.36 | 0.42 | — | .23 | .01 | — | .11 |
| 1426 | 33.11 | 25.22 | 4.35 | 1.07 | 0.48 | .04 | .48 | .01 | — | — |
| 1427 | 27.28 | 23.77 | 4.96 | 1.34 | 0.66 | .05 | .60 | .01 | .42 | .27 |
| 1428 | 30.50 | 24.93 | 4.60 | 1.28 | 0.59 | .05 | .46 | .01 | — | — |

Standard physical test blocks and corrosion test bars were prepared from each heat. Using the as cast non-heat-treated physical test blocks, the mechanical properties of each of these alloys were measured. The results of these measurements are set forth in Table II.

TABLE II

PHYSICAL PROPERTIES OF ALLOYS AS CAST

| ALLOY NUMBER | TENSILE STRENGTH P.S.I. | YIELD STRENGTH P.S.I. | TENSILE ELONGATION % | BRINELL HARDNESS NUMBER |
|---|---|---|---|---|
| 1418 | 68,300 | 32,900 | 36.0 | 128 |
| 1420 | 66,000 | 34,000 | 28.0 | 128 |
| 1423 | 67,000 | 35,000 | 58.0 | 123 |
| 1424 | 68,000 | 37,000 | 56.0 | 118 |
| 1425 | 65,800 | 30,200 | 61.0 | 112 |
| 1421 | 66,200 | 30,100 | 63.0 | 115 |
| 1422 | 78,000 | 47,000 | 37.5 | 168 |
| 1426 | 66,600 | 33,200 | 43.5 | 121 |
| 1427 | 77,100 | 34,600 | 44.0 | 126 |
| 1428 | 74,100 | 31,400 | 45.0 | 131 |

These alloys were also tested for magnetic permeability and all alloys measures less than 1.01 gausses per oersted, that is, they had no measurable magnetic permeabilities.

Without heat treatment, the corrosion test bars were machined into $1\frac{1}{2}$ inch diameter by $\frac{1}{4}$ inch thick discs, each having a $\frac{1}{8}$ inch diameter hole in the center. These discs were carefully machined and then ground to a 240-grit finish and polished to a 600-grit finish.

These discs were then used in the comparative corrosion tests, described hereinafter, comparing the performance of the alloys which either conform to the prior art or which are similar to the alloys of the invention but do not satisfy certain of the critical composition limitations of the alloys of the invention. The composition of the comparative alloys used in the test are set forth in Table III.

In the corrosion comparison data, the units employed to express the corrosion depth are mils. One mil equals 0.001 inch or 0.00254001 centimeter. The rate of corrosion attack is expressed as mils per year, M.P.Y. While in some situations an attack rate of 20 M.P.Y. or even 30 M.P.Y. may be tolerated, a rate of 10 M.P.Y. or less is much more often required for service in many chemical and power plant applications.

TABLE III

| PERCENT BY WEIGHT OF ALLOYING ELEMENTS | | | | | | | | | | |
|---|---|---|---|---|---|---|---|---|---|---|
| ALLOY NAME OR NUMBER | Ni | Cr | Mo | Cu | Mn | Cn | Si | C | Ti | N |
| 254SMO | 18.86 | 20.86 | 6.15 | .81 | .51 | — | .24 | .01 | — | .20 |
| IN862 | 24.22 | 21.12 | 5.08 | — | .66 | — | .80 | .02 | — | — |
| SANICRO 28 | 31 | 27 | 3.51 | 1.02 | .87 | — | .66 | .01 | — | — |
| JESSOP 777 | 25.37 | 22.10 | 4.73 | 1.88 | 1.22 | .33 | .24 | .02 | — | — |
| 1417 | 28.11 | 24.50 | 4.63 | .04 | 1.62 | — | .62 | .02 | — | — |
| 1419 | 28.92 | 24.91 | 4.66 | .11 | 1.86 | — | .72 | .02 | .4 | .20 |
| VEW A 963 | 16.15 | 17.01 | 6.31 | 1.57 | .77 | — | .58 | .02 | — | .19 |
| 2423 | 26.21 | 25.91 | 4.91 | 1.21 | .74 | .13 | .38 | .01 | — | .19 |
| 2424 | 25.81 | 25.88 | 4.91 | 2.87 | .75 | .11 | .38 | .01 | — | .17 |
| 2425 | 25.72 | 25.66 | 4.90 | 3.43 | .73 | .11 | .38 | .01 | — | .14 |

EXAMPLE 2

Using the disc samples of Example 1, samples of all heats were immersed in salt water to a depth of about 1¾ inches of solution held in plastic containers with tight-fitting lids. The salt water was prepared by dissolving 4 ounces of ordinary uniodized table salt per gallon of distilled water. Twenty-five different samples were placed flat on the bottom of each container in such a manner that no samples touched each other. The lids were employed to avoid evaporation and removed once a day long enough for sample inspection. The solution was removed and replaced every seven days. At the time of weekly solution changes the bottoms of all discs were examined to supplement the daily examination of the tops and edges. The weekly replacement solution were vigorously tumbled and agitated prior to use in order to provide well-aerated starting solutions at the beginning of each week. Past experience with this technique has shown that this test will quickly produce reddish-colored rust spots, and ultimately pits, in stainless steels and other metallic alloys not resistant to seawater.

The samples were so immersed for a total period of 100 days at ordinary room temperatures. At the end of 100 days none of the samples of the invention showed any rust, discoloration or pitting when examined under a 10-power magnifying glass. The first appearance of rust spots in other samples were as follows: 254SMO - 79 days, IN862 - 46 days, VE A963 - 55 days, SANICRO 28 - 83 days, JESSOP 777 - 21 days, 1417 - 8 days, 1419 - 12 days, 2423 - 11 days, 2424 - 13 days, and 2425 - 16 days.

EXAMPLE 3

Test discs of the alloy of this invention were suspended by platinum wires in 10%, 25%, 40%, 60% and 97% sulfuric acid-water solutions at 80° C. for 48 hours. Test discs of comparative alloys were also tested in these solutions. The test discs were weighed to the nearest 10,000th of a gram before and after exposure. The corrosion rate of each disc in mils per year was then calculated. The test results of the two day exposure are set forth in Table IV.

TABLE IV

| CORROSION RATE IN MILS OF PENETRATION PER YEAR (M.P.Y.) AT 80° C. IN VARIOUS SULFURIC ACID-WATER SOLUTIONS | | | | | |
|---|---|---|---|---|---|
| ALLOY DESIGNATION | 10% BY WEIGHT $H_2SO_4$ | 25% BY WEIGHT $H_2SO_4$ | 40% BY WEIGHT $H_2SO_4$ | 60% BY WEIGHT $H_2SO_4$ | 97% BY WEIGHT $H_2SO_4$ |
| 1418 | 10.2 | 7.5 | 9.2 | 34.0 | 3.1 |
| 1420 | 9.5 | 11.0 | 8.8 | 21.1 | 5.6 |
| 1423 | 1.4 | 0.0 | 0.1 | 1.2 | 9.2 |
| 1424 | 1.1 | 0.3 | 0.6 | 0.4 | 4.5 |
| 1425 | 1.4 | 6.2 | 0.0 | 0.0 | 8.9 |
| 1421 | 0.8 | 0.3 | 0.6 | 1.8 | 4.4 |
| 1422 | 1.0 | 0.8 | 0.3 | 0.2 | 3.3 |
| 1426 | 0.0 | 0.2 | 0.9 | 0.7 | 1.1 |
| 1427 | 0.0 | 0.3 | 0.9 | 0.5 | 2.2 |
| 1428 | 0.0 | 0.7 | 0.0 | 1.2 | 2.0 |
| 254SMO | 10.8 | 4.7 | 75.1 | 16.2 | 10.7 |
| IN862 | 2.2 | 3.0 | 13.5 | 8.2 | 8.8 |
| SANICRO 28 | 4.1 | 3.4 | 11.8 | 7.7 | 8.1 |
| 1417 | 19.1 | 31.0 | 2682.6 | 1085.4 | 14.5 |
| 1419 | 16.2 | 22.6 | 2430.7 | 1726.9 | 18.4 |
| VEWA963 | 64.6 | 62.7 | 68.8 | NT | 6.2 |
| 2423 | 1.6 | 4.7 | 7.2 | 0.1 | 49.3 |
| 2424 | 1.5 | 3.3 | 3.5 | 0.0 | 25.4 |
| 2425 | 1.7 | 6.6 | 7.5 | 0.0 | 9.1 |

EXAMPLE 4

Test discs of alloys of the invention, along with comparative samples of alloys not of this invention, were tested for 48 hours at 80° C. in 35% nitric acid-water solution, then in 35% nitric acid plus 4 ounces per gallon of salt, and also in 70% nitric acid water solution. The result of these tests are set forth in Table V.

TABLE V

| CORROSION RATE IN MILS OF PENETRATION PER YEAR (M.P.Y) IN 35% ACID-WATER, 70% NITRIC ACID-WATER, AND 35% NITRIC ACID-WATER PLUS 4 OUNCES/GALLON SALT ADDITION | | | |
|---|---|---|---|
| ALLOY DESIG-NATION | 35% BY WEIGHT $HNO_3$ | 70% BY WEIGHT $HNO_3$ | 35% BY WEIGHT $HNO_3$ + 4 OZ/GAL NaCl |
| 1418 | 1.2 | 0.0 | 3.5 |
| 1420 | 2.2 | 1.2 | 3.6 |
| 1421 | 0.7 | 0.8 | 0.9 |
| 1422 | 2.8 | 5.6 | 5.9 |

TABLE V-continued

CORROSION RATE IN MILS OF PENETRATION PER YEAR (M.P.Y) IN 35% ACID-WATER, 70% NITRIC ACID-WATER, AND 35% NITRIC ACID-WATER PLUS 4 OUNCES/GALLON SALT ADDITION

| ALLOY DESIGNATION | 35% BY WEIGHT $HNO_3$ | 70% BY WEIGHT $HNO_3$ | 35% BY WEIGHT $HNO_3$ + 4 OZ/GAL NaCl |
|---|---|---|---|
| 1423 | 0.9 | 2.2 | 0.0 |
| 1424 | 0.0 | 2.3 | 0.4 |
| 1425 | 2.2 | 5.2 | 0.9 |
| 1426 | 2.1 | 4.6 | 0.8 |
| 1427 | 0.9 | 1.7 | 0.0 |
| 1428 | 2.3 | 5.6 | 1.4 |
| 254SMO | 3.1 | 4.0 | 2.7 |
| IN862 | 0.4 | 0.4 | 0.4 |
| SANICRO 28 | 1.3 | 1.7 | 4.8 |
| 1417 | 1.6 | 0.3 | 3.9 |
| 1418 | 0.8 | 0.4 | 2.9 |
| VEWA963 | 2.0 | 3.1 | 11.1 |
| 2423 | 1.1 | 2.5 | 0.9 |
| 2424 | 0.4 | 2.4 | 0.0 |
| 2425 | 1.9 | 3.6 | 0.0 |

EXAMPLE 5

Test discs of the invention along with comparative samples of alloys not of this invention were tested for 48 hours at various temperatures in 70% phosphoric acid-water solution to which had been added 1/10 ounce of salt per gallon of solution. The results of these tests are set forth in Table VI.

TABLE VI

CORROSION RATE IN MILS OF PENETRATION PER YEAR IN 70% PHOSPHORIC ACID PLUS 1/10 OUNCE/GALLON SALT ADDITION AT VARIOUS TEMPERATURES

| ALLOY DESIGNATION | 70° C. | 80° C. | 90° C. | 100° C. |
|---|---|---|---|---|
| 1418 | 2.8 | 5.2 | 10.3 | 18.5 |
| 1420 | 4.9 | 8.5 | 13.6 | — |
| 1423 | 0.1 | 0.9 | 3.3 | 9.7 |
| 1424 | 0.7 | 1.9 | 5.1 | 12.6 |
| 1425 | 1.6 | 3.2 | 5.5 | 9.6 |
| 1421 | 1.8 | 3.6 | 6.4 | 11.2 |
| 1422 | 0.9 | 2.2 | 4.3 | 8.7 |
| 1424 | 0.1 | 0.1 | 0.3 | 0.7 |
| 1425 | 0.4 | 0.6 | 1.1 | 3.3 |
| 1426 | 0.4 | 0.6 | 1.2 | 3.5 |
| JESSOP 777 | 5.5 | 9.5 | 15.5 | 23.6 |
| SANICRO 28 | 1.9 | 3.7 | 6.8 | 13.6 |
| IN862 | 4.3 | 7.5 | 12.2 | 17.7 |
| 254SMO | 5.1 | 9.6 | 17.0 | 28.4 |
| 1417 | 4.2 | 7.3 | 13.2 | 21.4 |
| 1419 | 4.0 | 8.3 | 13.8 | 22.5 |
| VEWA963 | 9.5 | 43.5 | 78.8 | 114.2 |

EXAMPLE 6

Test discs of alloys of this invention, along with comparative samples of alloys not of this invention, were tested for 48 hours at various temperature in 86% phosphoric acid-water solution to which 4 ounces of salt had been added per gallon of solution. Results of these tests are set forth in Table VIII.

TABLE VII

CORROSION RATE IN MILS OF PENETRATION PER YEAR (M.P.Y.) IN 86% PHOSPHORIC ACID PLUS 4 OUNCE/GALLON SALT ADDITION AT VARIOUS TEMPERATURES

| ALLOY DESIGNATION | 70° C. | 75° C. | 80° C. | 85° C. |
|---|---|---|---|---|
| 1418 | 4.5 | 10.4 | 17.8 | 26.5 |

TABLE VII-continued

CORROSION RATE IN MILS OF PENETRATION PER YEAR (M.P.Y.) IN 86% PHOSPHORIC ACID PLUS 4 OUNCE/GALLON SALT ADDITION AT VARIOUS TEMPERATURES

| ALLOY DESIGNATION | 70° C. | 75° C. | 80° C. | 85° C. |
|---|---|---|---|---|
| 1420 | 9.5 | 17.4 | 29.3 | 42.8 |
| 1421 | 2.9 | 6.7 | 11.2 | 18.2 |
| 1422 | 7.8 | 14.1 | 25.6 | 40.1 |
| 1423 | 4.1 | 8.9 | 15.2 | 22.3 |
| 1424 | 4.9 | 10.6 | 19.2 | 29.8 |
| 1425 | 1.1 | 1.9 | 7.3 | 15.0 |
| 1426 | 3.1 | 6.7 | 11.7 | 17.7 |
| 1427 | 7.9 | 14.7 | 25.2 | 39.3 |
| 1428 | 8.1 | 13.1 | 19.6 | 28.2 |
| 254SMO | 4.1 | 18.5 | 43.5 | 77.2 |
| IN862 | 5.4 | 7.5 | 9.5 | 12.8 |
| VEWA963 | 33.6 | 24.6 | 50.7 | 87.2 |
| 1417 | 12.5 | 21.4 | 32.1 | 48.2 |
| 1419 | 15.1 | 28.3 | 44.5 | 61.1 |

EXAMPLE 7

Test samples of alloys of this invention, along with comparative samples of alloys not of this invention, were tested in an aqua regia solution prepared by mixing one part concentrated 70% nitric acid mixed with 3 parts concentrated 37% hydrochloric acid. This solution contained 17.5% nitric acid, 27.75% hydrochloric acid and 54.75% water. The results of the tests in this solution are set forth in Table VIII.

TABLE VIII

CORROSION RATE IN MILS OF PENETRATION PER YEAR (M.P.Y.) IN AQUA REGIA (17.5% NITRIC ACID & 27.7% HYDROCHLORIC ACID IN WATER)

| ALLOY DESIGNATION | ROOM TEMPERATURE | 50° C. | 70° C. |
|---|---|---|---|
| 1418 | 11.7 | 19.1 | 23.7 |
| 1423 | 2.3 | 4.5 | 8.4 |
| 1424 | 2.0 | 5.4 | 9.5 |
| 1425 | 1.8 | 5.2 | 10.1 |
| 1421 | 2.4 | 5.1 | 6.3 |
| 1426 | 0.0 | 6.3 | 9.8 |
| 254SMO | 178.9 | N.T. | BOILED |
| IN862 | 20.0 | N.T. | VIOLENTLY. |
| JESSOP 777 | 60.3 | N.T. | IMMEDIATELY |
| VEWA963 | 623.1 | N.T. | REMOVED. |
| 1419 | 21.0 | 47.8 | 79.3 |
| 2423 | 3.2 | 23.5 | 88.0 |
| 2424 | 2.9 | 68.2 | 312.2 |
| 2425 | 2.6 | 122.5 | 638.4 |

*N.T. = NOT TESTED

The above examples demonstrate how the alloys of this invention have excellent mechanical properties for fabricability, while being impervious to salt water and maintaining excellent corrosion resistance to a very wide range of very aggressive chemical substances that may be contaminated with chlorides.

I claim:

1. An air-meltable, castable, workable, non-magnetic alloy resistant to chlorides and other corrosive chemicals, consisting essentially of between about 20.5% and about 32% nickel, between about 23.5% and about 27.5% by weight chromium, between about 4.0% and about 6.7% by weight molybdenum, between about 0.7% and about 3.6% by weight copper, up to about 0.09% by weight carbon, up to about 1.5% by weight silicon, up to about 5% by weight cobalt, up to about 0.45% by weight nitrogen, up to about 1% by weight titanium, up to about 0.8% by weight niobium, up to about 0.3% of a rare earth component selected from the group consisting of cerium, lanthanum, and misch metal, up to about 2% by weight manganese, up to about 1.6% by weight tantalum, and the balance essentially iron, the sum of the nickel content and the cobalt content being between about 25.5% and 32% by weight and exceeding the chromium content by between about 2% and about 6.2% by weight, basis the entire alloy.

2. An alloy as set forth in claim 1 wherein the sum of the nickel content and the cobalt content exceeds the chromium content by between about 2.5% and about 5% by weight.

3. An alloy as set forth in claim 2 wherein the sum of the nickel content and the cobalt content exceeds the chromium content by between about 3.5% and about 4.5% by weight.

4. An alloy as set forth in claim 1 wherein the molybdenum and chromium contents satisfy the relationship:

$$[Mo] \geqq \frac{31}{[Cr] - 12} + 2$$

where

[Mo]=weight % molybdenum and

[Cr]=weight % chromium

5. An alloy as set forth in claim 4 wherein the molybdenum and chromium content satisfy the further relationship:

$$[Mo] \leqq \frac{31}{[Cr] - 12} + 4$$

6. An alloy as set forth in claim 1 wherein the sum of the niobium content and one-half the tantalum content is at least 8 times the carbon content.

7. An alloy as set forth in claim 6 wherein the sum of the niobium content and one-half the tantalum content is not greater than about 0.8% by weight.

8. An alloy as set forth in claim 7 wherein the titanium, niobium, tantalum and carbon contents conform to the relationship:

$$\frac{1}{4}\,Ti + \frac{1}{8}\,Nb + \frac{1}{16}\,Ta \geqq C$$

where

[Ti]=weight % titanium

[Nb]=weight % niobium (columbium)

[Ta]=weight % tantalum, and

[C]=weight % carbon.

9. An alloy as set forth in claim 1 wherein the nickel content is between about 21% and about 32% by weight, the copper content is between about 0.9% and about 3.5% by weight, the manganese content is between 0.3% and about 2% by weight, the niobium content is not greater than about 0.55% by weight, the nitrogen content is not greater than about 0.30% by weight, the silicon content is between about 0.2% and about 1% by weight, the carbon content is not greater than about 0.09% by weight, the titanium content is not greater than about 0.7% by weight, and the sum of the nickel content and the cobalt content is between about 26% and about 32% by weight and exceeds the chromium content by between about 2.5% and about 6.2% by weight.

10. An alloy as set forth in claim 1 wherein the nickel content is between about 21.5% and about 32% by weight, the chromium content is between about 24% and about 27% by weight, the molybdenum content is between about 4.1% and about 6.1% by weight, the copper content is between about 0.9% and about 2.0% by weight, the manganese content is between about 0.3% and about 2% by weight, the niobium content is not greater than about 0.25% by weight, the nitrogen content is not greater than about 0.25% by weight, the silicon content is between about 0.2 and about 0.8% by weight, the carbon content is not greater than about 0.03% by weight, and the sum of the nickel content and the cobalt content is between about 26.5% and about 32% by weight and exceeds the chromium content by between about 3.5% and about 5% by weight.

11. An alloy as set forth in claim 1 wherein the nickel content is between about 22.5% and about 32% by weight, the chromium content is between about 24% and about 26% by weight, the molybdenum content is between about 4.2% and about 5.0% by weight, the copper content is between about 0.9% and about 1.6% by weight, the manganese content is between about 0.5% and about 1.8% by weight, the niobium content is not greater than about 0.25% by weight, the nitrogen content is not greater than about 0.20% by weight, the silicon content is between about 0.2% and about 0.8% by weight, the carbon content is not greater than about 0.03% by weight, and the sum of the nickel content and the cobalt content is between about 27.5% and about 32% by weight and exceeds the chromium content by between about 3.5% and 4.5% by weight.

12. An air meltable, castable, workable, non-magnetic alloy resistant to chlorides and a variety of chemical materials, consisting essentially of about 29% by weight nickel, about 25% by weight chromium, about 4.7% by weight molybdenum, about 1% by weight copper, about 0.75% by weight manganese, about 0.4% by weight silicon, about 0.02% by weight carbon, and the balance essentially iron.

* * * * *